US007677435B2

(12) United States Patent
Stahlecker

(10) Patent No.: US 7,677,435 B2
(45) Date of Patent: Mar. 16, 2010

(54) DOUBLE-WALLED PAPERBOARD CUP

(75) Inventor: Werner Stahlecker, Goeppingen (DE)

(73) Assignee: PTM Packaging Tools Machinery Pte. Ltd., Singapore (SG)

( * ) Notice: Subject to any disclaimer, the term of this patent is extended or adjusted under 35 U.S.C. 154(b) by 46 days.

(21) Appl. No.: 11/401,034

(22) Filed: Apr. 10, 2006

(65) Prior Publication Data

US 2006/0226210 A1 Oct. 12, 2006

(30) Foreign Application Priority Data

Apr. 12, 2005 (DE) ..... 10 2005 017 741

(51) Int. Cl.
*B65D 3/22* (2006.01)
*B65D 21/02* (2006.01)

(52) U.S. Cl. ..... 229/403; 206/515; 206/519

(58) Field of Classification Search ..... 229/403; 206/515, 519, 520; 220/592.17, 592.22, 220/62.12, 62.18, 62.19, 737, 738, 739
See application file for complete search history.

(56) References Cited

U.S. PATENT DOCUMENTS

| | | | | | |
|---|---|---|---|---|---|
| 3,456,860 | A | * | 7/1969 | Janninck | 229/400 |
| 3,612,346 | A | * | 10/1971 | Schneider | 206/519 |
| 3,648,888 | A | * | 3/1972 | Cheladze | 206/519 |
| 3,927,766 | A | * | 12/1975 | Day | 206/519 |
| 4,049,122 | A | * | 9/1977 | Maxwell | 206/519 |
| 4,102,454 | A | * | 7/1978 | Karevaara | 206/519 |
| 5,524,817 | A | * | 6/1996 | Meier et al. | 229/403 |
| 5,820,016 | A | * | 10/1998 | Stropkay | 229/403 |
| 6,109,518 | A | * | 8/2000 | Mueller et al. | 229/403 |
| 6,497,338 | B1 | | 12/2002 | Stolzman | |
| 7,100,770 | B2 | * | 9/2006 | D'Amato | 206/505 |

FOREIGN PATENT DOCUMENTS

| | | | |
|---|---|---|---|
| EP | 1 227 042 | B1 | 7/2002 |
| EP | 1 227 043 | B1 | 7/2002 |
| GB | 2 398 267 | A | 8/2004 |
| JP | 3383698 | | 6/1995 |
| JP | 07149338 | A2 | 6/1995 |
| JP | 2000302132 | A2 | 10/2000 |

OTHER PUBLICATIONS

Great Britain Patent Office Search Report dated Jul. 26, 2006 (3 pages).

* cited by examiner

*Primary Examiner*—Gary E Elkins
(74) *Attorney, Agent, or Firm*—Flynn, Thiel, Boutell & Tanis, P.C.

(57) ABSTRACT

Described is a double-walled heat-insulating paperboard cup which stacks with the aid of an upper stacking stopper. A particularly stable design is achieved by means of the embodiment of the upper stacking stopper, which results in good stackability and de-stackability of the cups. Furthermore a process is described which is applied for the manufacture of a cup of this type.

3 Claims, 10 Drawing Sheets

DOUBLE-WALLED PAPERBOARD CUP

BACKGROUND AND SUMMARY OF THE INVENTION

Figure 1:
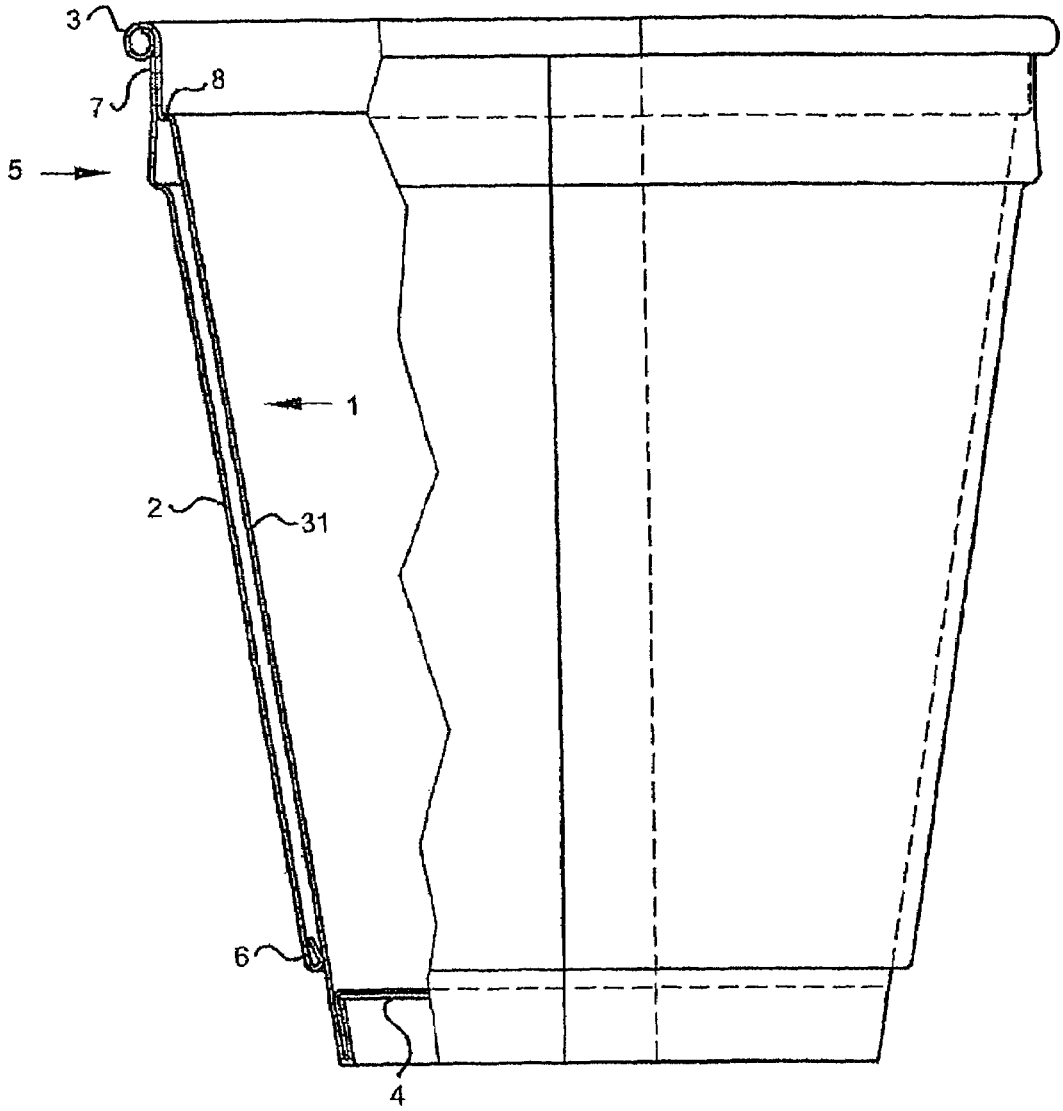

The present invention relates to a double-walled stackable and de-stackable paperboard cup comprising an inner cup, an outer sleeve with a gap between inner cup and outer sleeve, said outer sleeve being attached below the drinking lip of the inner cup, also comprising a rolled lip applied to the lower end of the outer sleeve and disposed on the inner sleeve.

A container of this type is prior art in European patent 1 227 042. A heat-insulating cup is described, which is formed by two conical sleeves, whereby the inner sleeve comprises an inwardly directed groove, which serves to permit the stacking of an identical cup inside said cup already stacked. The inwardly directed groove, formed by means of rolling, should serve to provide the cup with good stacking and de-stacking properties so that a number of stacked cups do not get stuck inside one another. Experience has shown that the stacking properties are satisfactory for approximately 20 cups. If more than this number of cups are stacked together, they become stuck. This is caused in particular by axial pressure, directed from the cup opening to the cup bottom, which is generated by the weight of many cups stacked on top of each other. Even the moderate setting down of 50 packed and stacked cups can result in them becoming stuck to one another. The cause of the cups becoming stuck together must be seen in the insufficient stiffness of the groove, which, however, cannot be improved while applying this method of production, as the rolling process results in a weakness in the material.

In European published patent 1 227 043, a better thermal insulation of the cup disclosed is utilized, which cup possesses the same stacking properties of the above described cup.

One-walled stackable paperboard cups are disclosed in Japanese published patent application 2000-302132, which achieve a stacking of the inner paperboard cup in the outer paperboard cup in the upper area of the cup by means of clamping. This clamping results in the paperboard cups not being easily de-stackable. In addition, the one-walled design leads to a low thermal insulation.

It is an object of the present invention to significantly improve the stacking and de-stacking properties of paperboard cups of the above mentioned type. In particular, in contrast to prior art, a significantly greater number of cups should be stackable, which in particular do not become stuck to one another when a large number of stacked cups are set down with a jolt, or when in any other way a high level of axial pressure acts on the stacked cups, for example when a cup magazine is filled.

This object has been achieved in accordance with the present invention in that on the outer sleeve, a shoulder-shaped stacking stopper is designed, which is assigned to the drinking lip.

In non-generic one-walled plastic cups it is known (Japanese published patent 33 83 698) that the sleeve is provided with a stacking stopper, which is supported on the upper inner rim during stacking. The stacking stopper is in this case designed in such a way that in the case of too high pressure, in particular in the case of a downward jolt, the stacked cups may become stuck inside one another, because the distribution of the forces in the area of the stacking stopper at too high an axial pressure can result in the cup wall of the stacked cup giving way inwardly.

In the case of the cup according to the present invention, the stacking shoulder is applied to the outer sleeve, that is, the stacking shoulder is not located on that sleeve on which the drinking lip is located. This gives rise to two advantages which no stackable cup has yet possessed. Firstly, the stacking stopper can be applied in such a way that the stacked cup is supported there where the stacking cup possesses good stability, namely at the drinking lip. Secondly, by means of the geometric shape of the stacking stopper, the acting force of the stacked paperboard cup on the drinking lip of the stacking paperboard cup is directed normally onto the surface of the drinking lip. Thus a giving way of the outer sleeve of the stacked paperboard cup is avoided, even at very high axial pressure which could act on the cup opening, whereby a very stable design is achieved.

The paperboard cup can be made in a variety of embodiments. The inner cups of paperboard cups having a low volume do not need to comprise an inner shoulder, as the drinking lip for smaller cup openings is sufficiently stable in radial direction. In the case of larger paperboard cups, the application of an inner shoulder to support the stacking stopper is recommended. The application of an inner shoulder increases the radial stability of the stacking stopper. In addition the surface temperature of the outer sleeve can be altered by the application of the shoulder. The inner shoulder increases the gap between the inner cup and the outer sleeve, whereby the insulating effect of the double-walled design is is further increased. Also, there is a relatively wide choice of supporting positions of the rolled lip.

In order to achieve an economical, material-saving manufacture of the paperboard cup, the support of the rolled lip can be located several millimeters above the bottom of the cup without the stacking properties being altered hereby. If maximum stability of the paperboard cup is required, then the support of the rolled lip should be located exactly at the level of the cup bottom. In this embodiment, the paperboard cup is visually at its most attractive, resulting in the highest possible sales.

The present invention also relates to a process in which the paperboard cup is manufactured. An outer sleeve, comprising a rolled lip, is hereby made during preliminary procedural steps, which are not described here. The stacking stopper is subsequently applied. This takes place in a forming station, which comprises the following components: a lower cup support, a cup take-up and the pressing arrangement. After the stacking stopper has been applied, the outer sleeve is transported to further stations, where it is equipped with the inner cup and finished.

Figure 2:
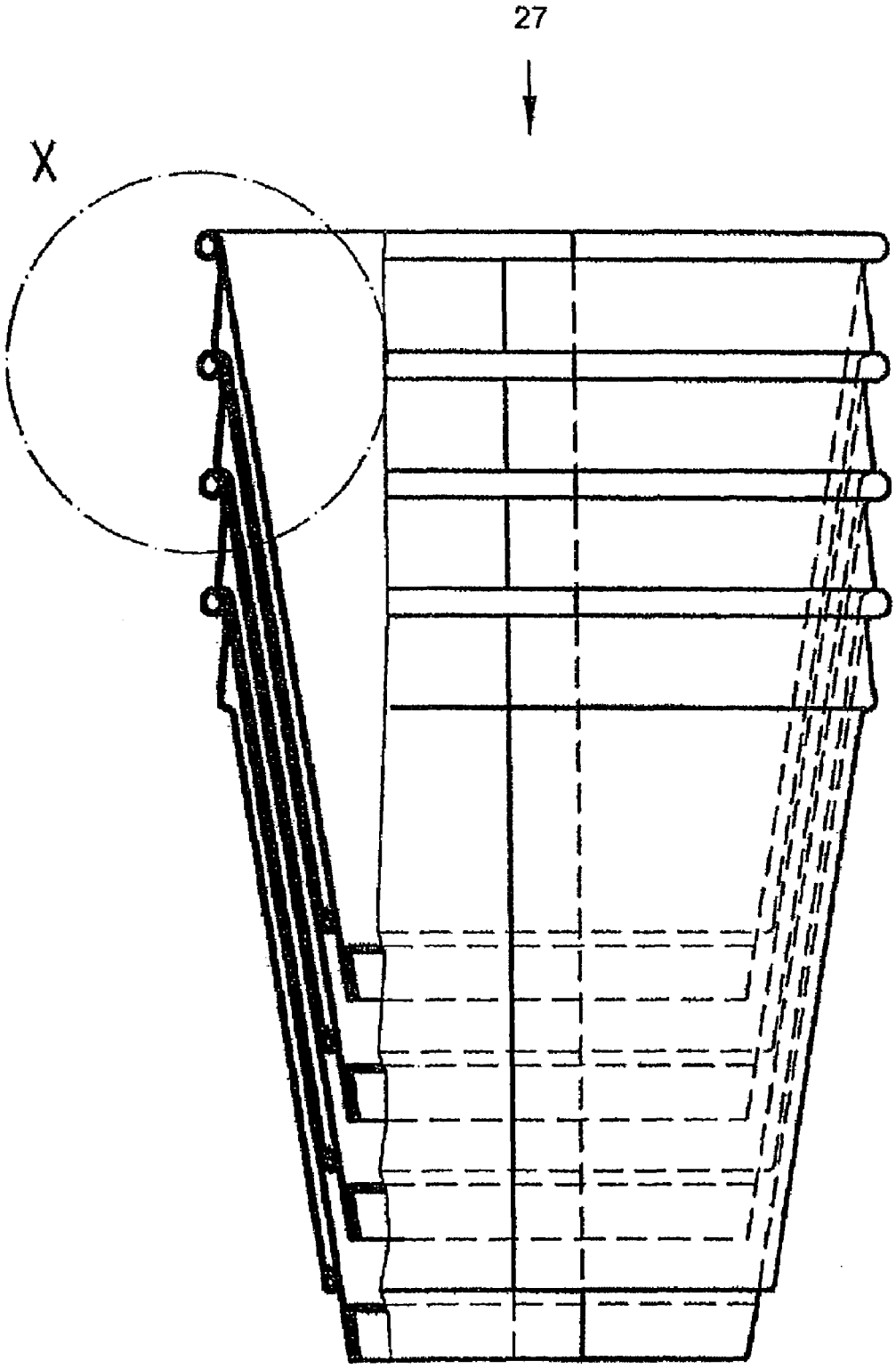
Figure 4:
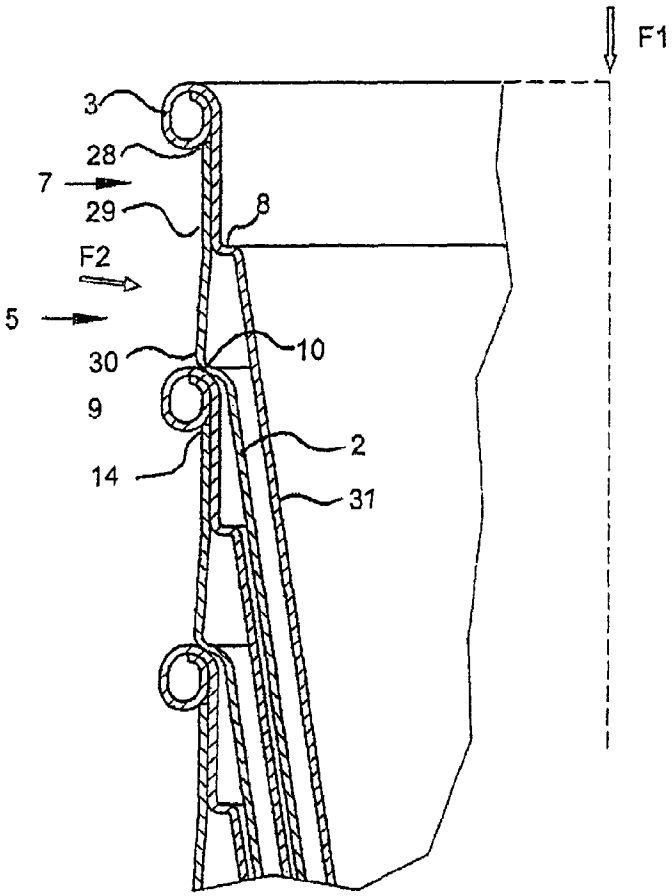
Figure 3:
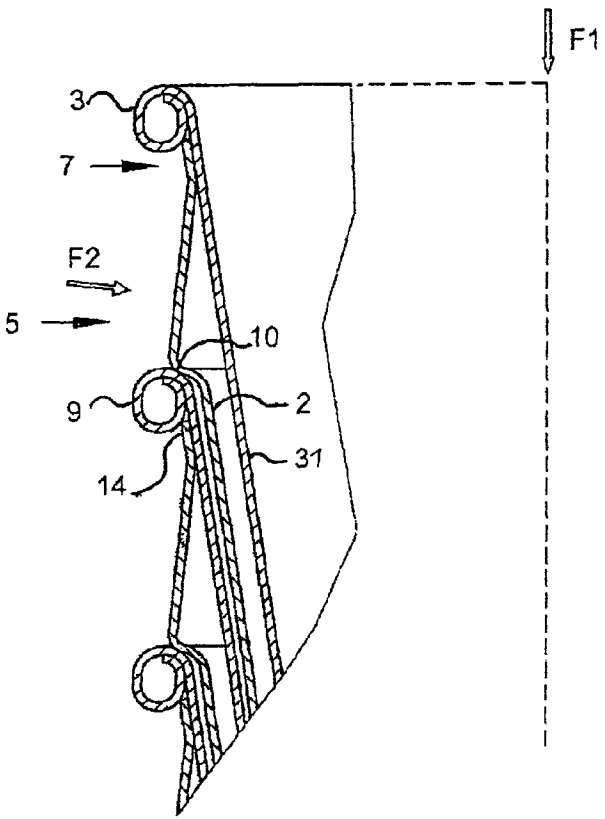
Figure 6:
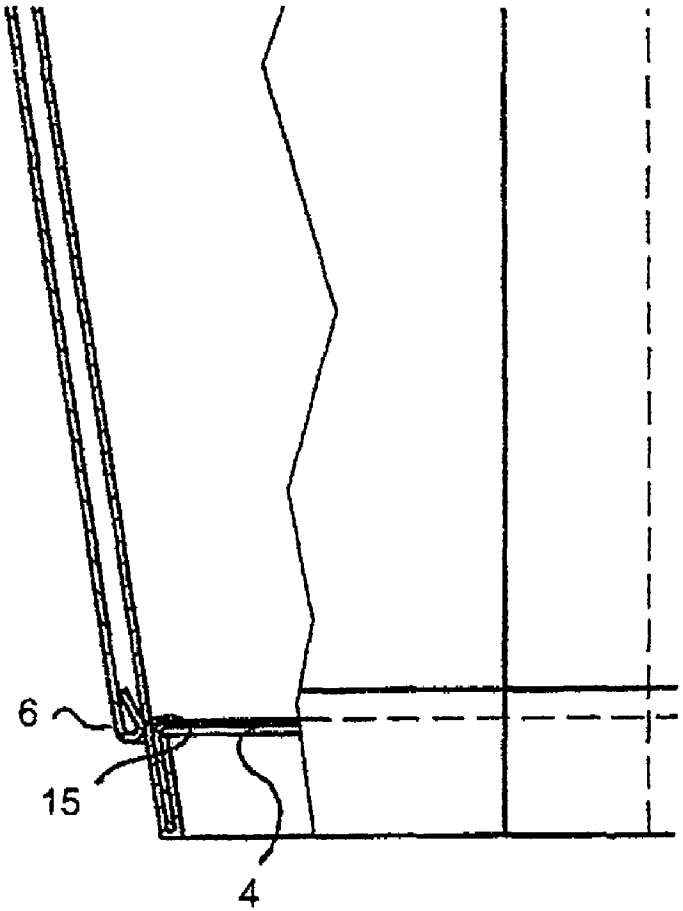
Figure 5:
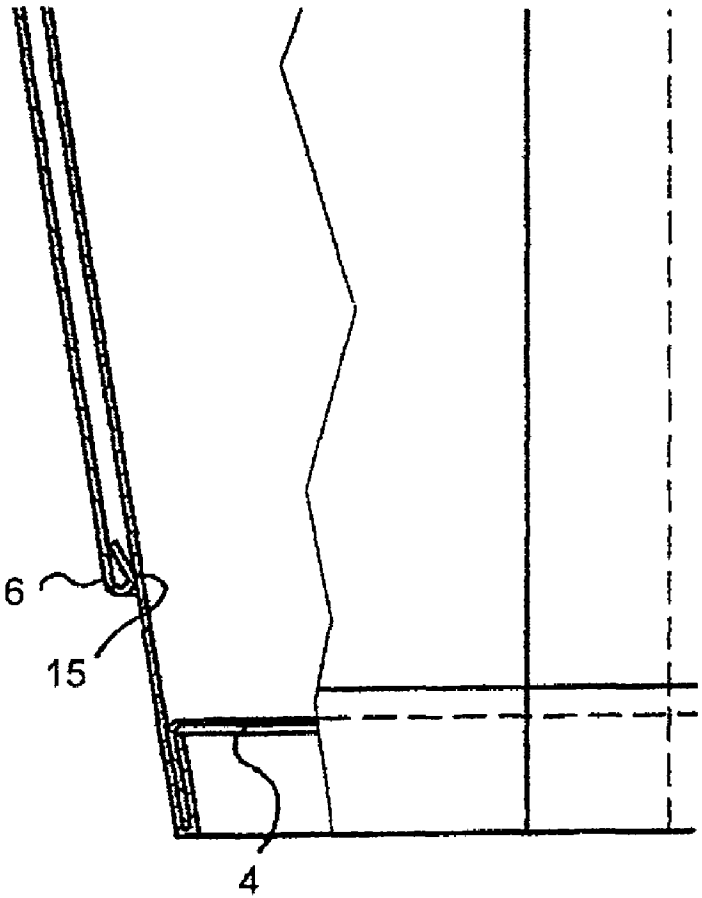
Figure 7:
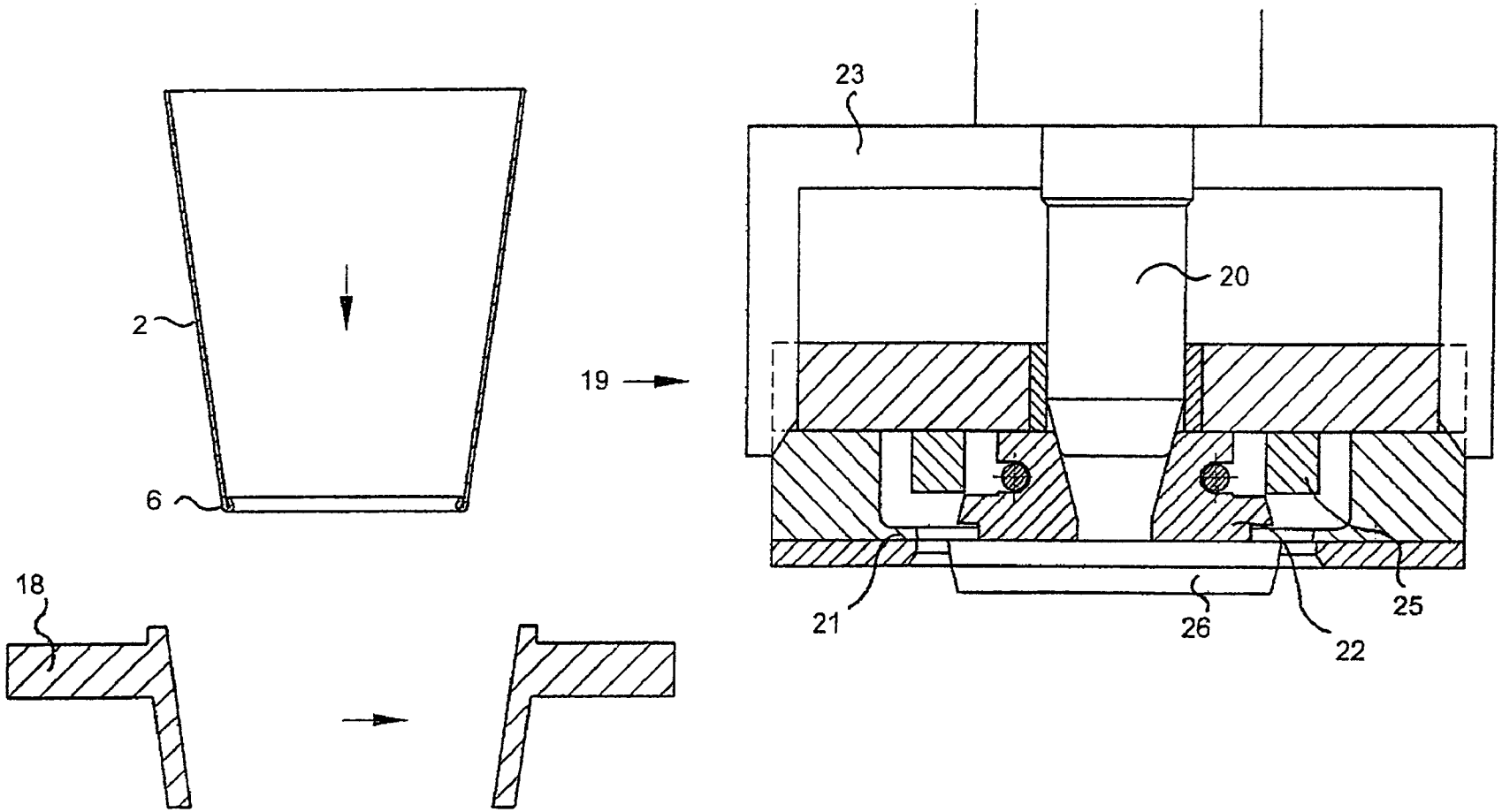
Figure 8:
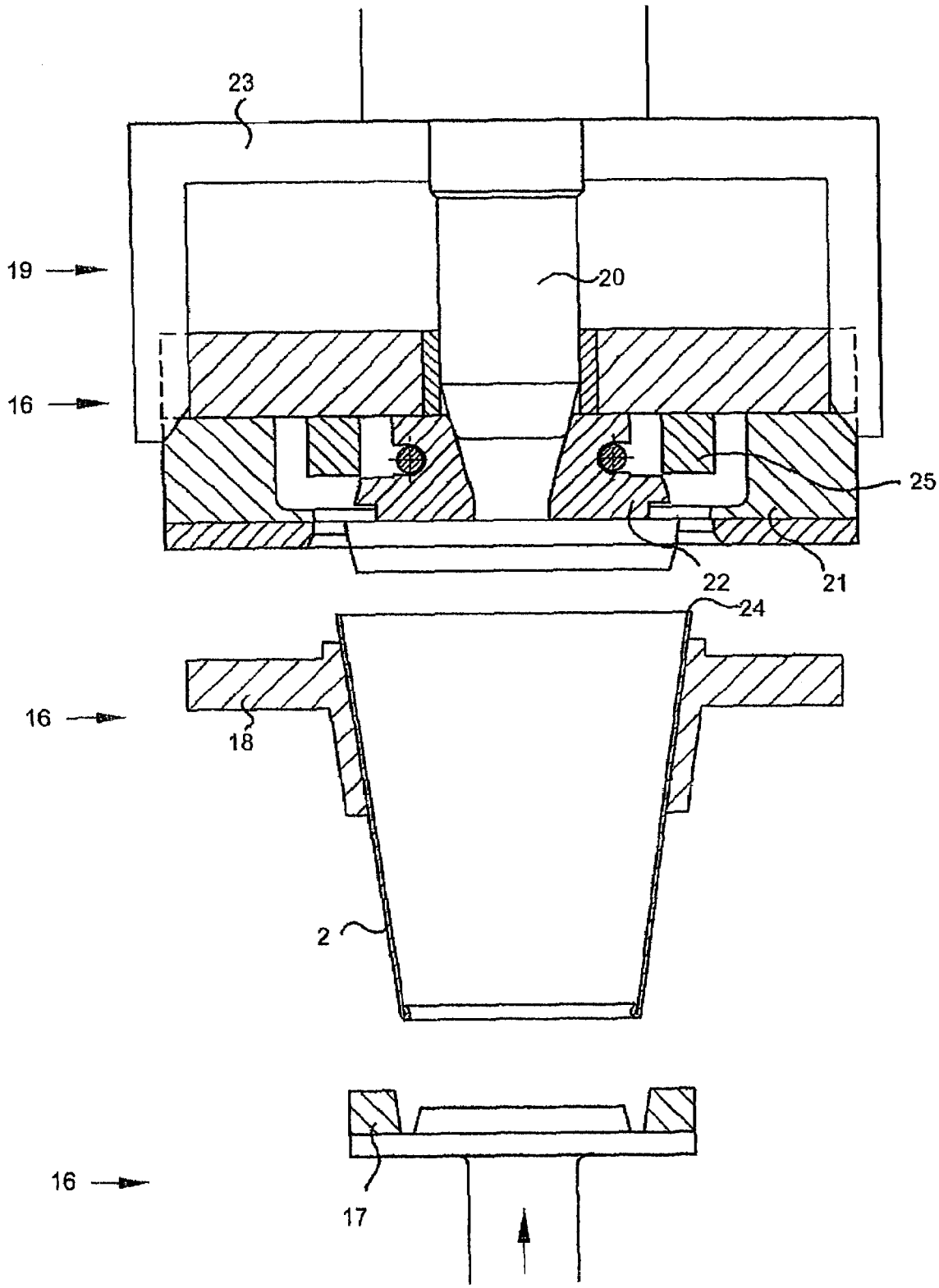
Figure 9:
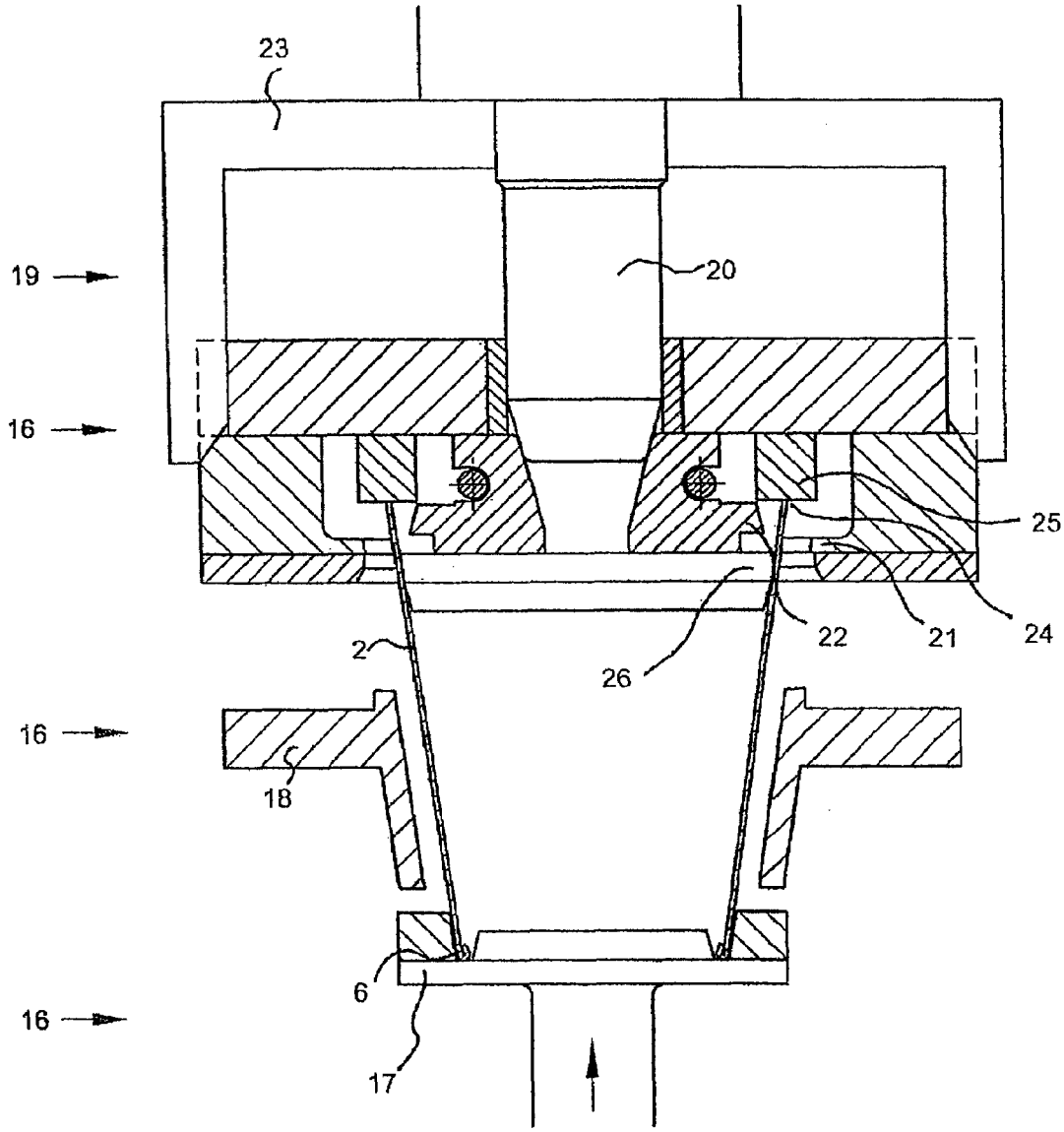
Figure 10:
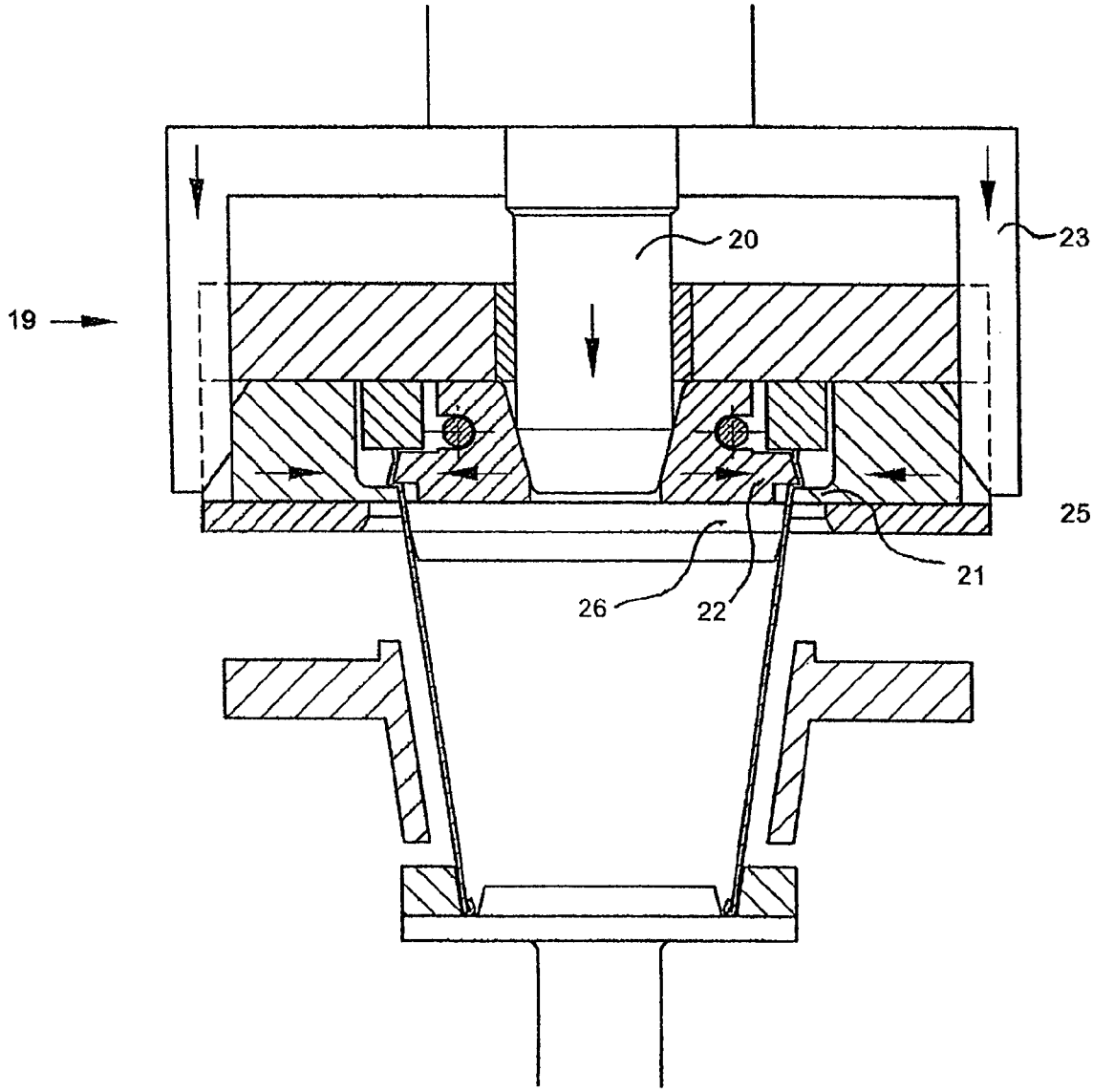
Figure 11:
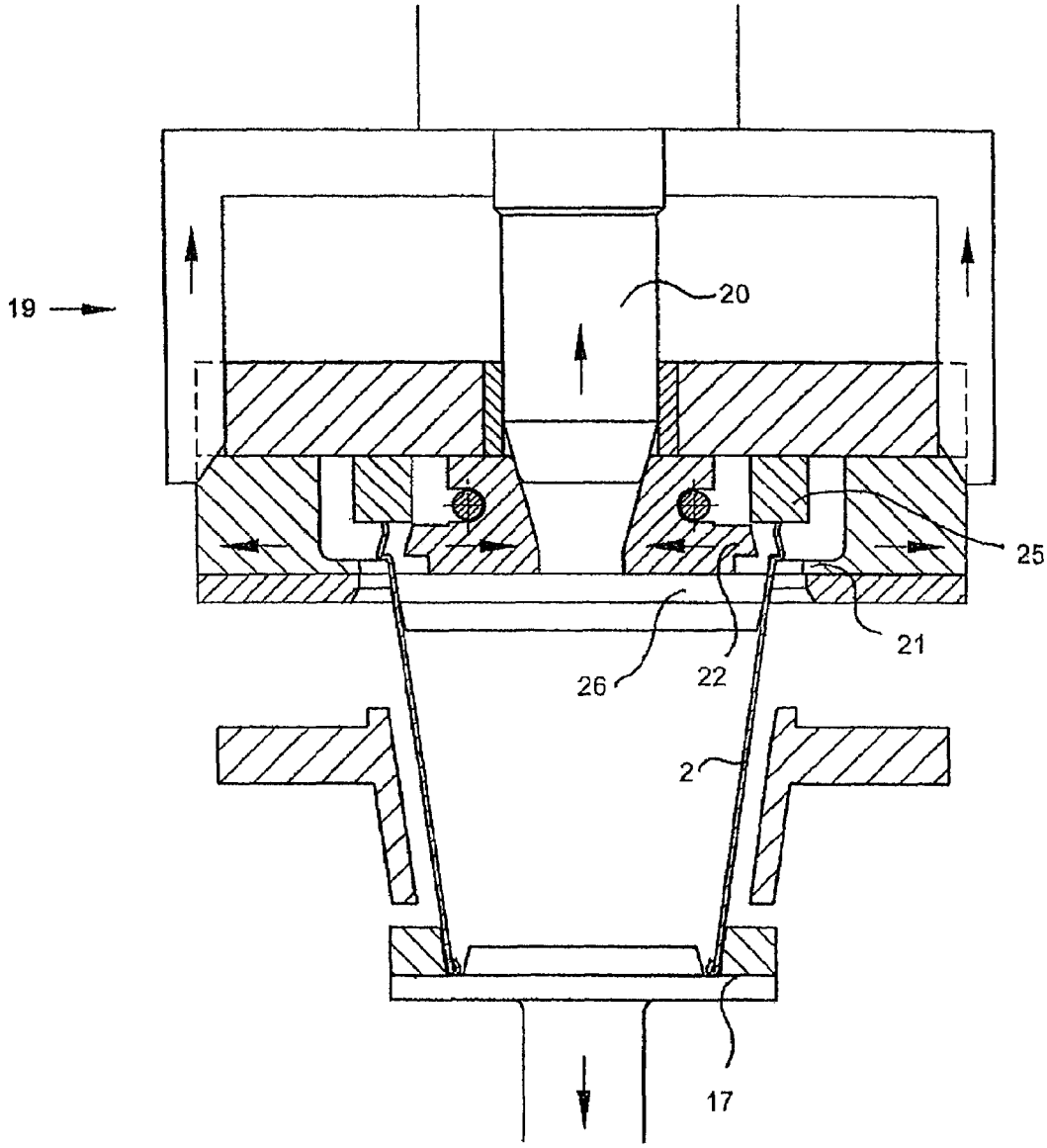
Figure 12:
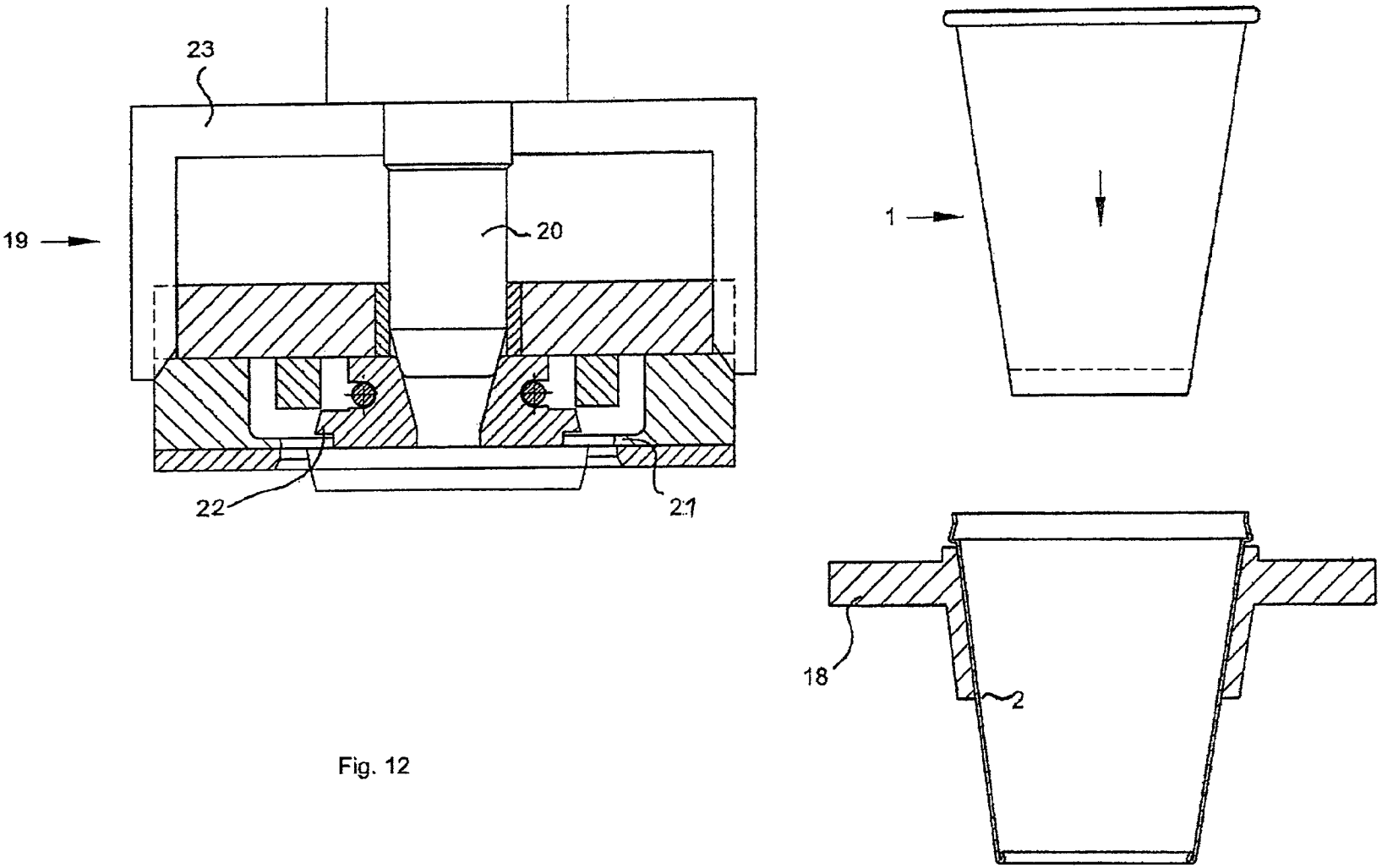

Several drawings are described below, which illustrate the advantages and features of the paperboard cup, in which FIG. 1 is a partly intersectional depiction of a first embodiment of a stackable, heat-insulating paperboard cup, FIG. 2 shows four stacked paperboad cups, FIG. 3 shows an enlarged view of area X of the paperboard cup according to FIG. 2, FIG. 4 shows an enlarged view of area X according to FIG. 2, whereby, however, a shoulder is applied in the inner cup, FIG. 5 shows a paperboard cup, in which the rolled lip is applied above the bottom, FIG. 6 shows a paperboard cup, in which the rolled lip is applied at the level of the bottom, FIG. 7 shows the feeding of the outer sleeve to the forming station for the application of the stacking stopper, FIG. 8 shows the fit of the outer sleeve in the cup take-up of the partly closed forming station, FIG. 9 the fit of the outer sleeve in the cup take-up of the closed forming station before the execution of the pressing of the stacking stopper, FIG. 10 shows the closed pressing arrangement, in which arrows denote the direction of forces on the pressing jaws, FIG. 11 shows the pressing arrangement opened again after the formation of the stacking stopper, in which arrows denote the direction of the forces on the pressing jaws, FIG. 12 shows the equipping of the outer sleeve with the inner cup.

DETAILED DESCRIPTION OF THE DRAWINGS

The heat-insulating paperboard cup shown in FIG. 1 partly in longitudinal section comprises an inner cup 1 and an outer sleeve 2. The inner cup 1 comprises an inner sleeve 31 and a bottom 4. A drinking lip 3 is applied to the inner sleeve 31. The stacking of the paperboard cup is achieved by means of the shoulder-shaped stacking stopper 5. The outer sleeve 2 is attached by means of the upper stopper 7 in the area of the cup opening below the drinking lip 3 to the outside of the inner sleeve 31. The lower end of the outer sleeve 2 is provided with a rolled lip 6 which is rolled inwards. The embodiment of the upper stopper 7, the shoulder-shaped stacking stopper 5 and a possible upper shoulder 8 applied to the inner sleeve 31 below the drinking lip 3 define the stacking and insulating properties of the paperboard cup.

In FIG. 2, four stacked paperboard cups according to the paperboard cup in FIG. 1 are shown. An area X is marked in this Figure, which is shown in FIGS. 3 and 4 in enlarged dimensions. In the embodiment chosen in FIG. 2, the paperboard cups do not possess an upper shoulder 8, which renders the insulating properties of these paperboard cups slightly less effective, in comparison to the paperboard cup according to FIG. 1. The degree of insulation of the paperboard cup and thus its geometric form is determined in particular by the temperature of the liquid to be filled into the cup. The material thickness of the inner cup, followed by the gap between the inner cup and the outer sleeve and the thickness of the material of the outer sleeve all determine the drop in temperature between the drink in the cup and the hand holding it. The mass per unit area of the paperboard of the inner and outer sleeves amounts, as a rule, to several hundred grammes per square metre; in the case of coffee cups, a paperboard having 350 $g/m^2$ is often used. The paperboard of the inner cup is polyethylene-coated, whereby the mass per unit area of the coating lies normally in the range between 15 to 30 $g/m^2$. The gap between the inner and outer sleeve measures approximately 1.2 mm at mid-cup height. Thus a liquid having a temperature of 80° C., which is filled into a paperboard cup according to FIG. 1, achieves an outer temperature of below 60° C., permitting the paperboard cup to be held in the hand for a longer time without causing pain. If liquids are filled in having temperatures which approximate the boiling point of water, a paperboard cup according to FIG. 2 can then deliver a sufficient insulating effect, as long as the diameter difference of the shoulder 8 measures approximately 1.2 mm.

For large paperboard cups, for instance, having a volume of 400 ml, the diameter of the cup opening 27 (FIG. 2) is so large that radial stability decreases. In particular when paperboard cups are gripped with excessive force at the shoulder-shaped stacking stopper 5, this can become so deformed that, for example, individual cups can become stuck during temporary storage. This disadvantage is eliminated by means of an inner shoulder 8, which is located in the area of the stacking shoulder. Shoulders of this type are known in German published patent appllication 198 40 841, but are only used in order to improve the general deforming of the cup opening without any particularly good stacking properties arising therefrom.

For paperboard cups of the present invention, the shoulders 8 have the capacity to stabilize the upper stopper 7, whereby the stability of the shoulder-shaped stacking stopper 5 is increased and the likelihood of the stacking stopper 5 being deformed is reduced.

FIG. 3 illustrates the excellent stacking and de-stacking properties of the paperboard cup of the present invention. Stacking of a paperboard cup is achieved by the contact 10 of the drinking lip 9 of the stacked paperboard cup and the shoulder-shaped stacking stopper 5 of the paperboard cup being stacked. The axial force F1, which, for example could act by means of pressure from above on the stacked paperboard cups and which axial force F1 is denoted in FIGS. 3 and 4 by a double arrow, is absorbed between the contact 10 of the stacking stopper 5 and the upper stopper 7 of the outer sleeve 2, which is adhered to the inner sleeve 31. As the force at the contact 10 of the stacking stopper 5 is directed normally onto the drinking lip 9, no force is generated in the direction of the inner sleeve 31, whereby no movement either of the outer sleeve 2 of the paperboard cup being stacked is generated in the direction of the inner sleeve 31, thus resulting in an extremely stable stacking design. The stability is only limited by the pressure of the drinking lip 9 of the stacked paperboard cup and by the support of the drinking lip by means of the upper stopper 14 of the outer sleeve 2. The radial increase in stability of the shoulder-shaped stacking stopper can be seen in a comparison of FIGS. 3 and 4 and comparing the action of the force F2. The force F2 is denoted by the direction of a double arrow and should act in the area of the stacking stopper 5. Due to the design of the shoulder 8, a large cylindrical area 28 to 29 is formed, which reduces the likelihood of the shoulder-shaped stacking stopper 5 being deformed because said cylindrical area 28 to 29 reduces the free-standing area of the outer sleeve 2 in the area from 29 to 30.

The FIGS. 5 and 6 illustrate the position 15 of the support of the rolled lip 6. For an economical production of the paperboard cup, the position 15 of the rolled lip 6 can be applied several millimeters above the paperboard cup bottom (see FIG. 5), whereby a saving in material of up to 20% can be achieved. If great stability is required, then the position 15 of the rolled lip should be applied to the level of the paperboard cup bottom (see FIG. 6), as then the force from gripping the cup is absorbed by the cup bottom 4.

In FIGS. 7 to 12 the essential procedural stages for applying the stacking stopper 5 with the aid of various states of the forming station 16 are shown. The forming station 16 comprises the cup take-up 18, the lower cup support 17 and the pressing arrangement 19, whereby the lower cup support 17 is not shown in FIGS. 7 and 12.

FIG. 7 shows the feeding of the outer sleeve into the cup take-up 18 of the forming station 16. The outer sleeve 2 already possesses the lower rolled lip 6, which is applied in advance procedural steps. As soon as the cup take-up is equipped with the outer sleeve 2, it is carried between the lower cup support 17 and the pressing arrangement 19. This state is shown in FIG. 8.

In order to apply the shoulder-shaped stacking stopper 5, the outer sleeve 2 is brought into the pressing arrangement 19. The lower take-up support 17 is carried so far in the direction of the pressing arrangement 19 until the outer sleeve 2 touches with its upper edge 24 the stop ring 25 of the pressing arrangement 19. The forming station is then closed. This state is shown in FIG. 9.

The pressing arrangement 19 is subsequently closed. The outer slider 23, as shown in FIG. 10, travels downwards so that it drives the outer jaws 21 radially inwards. In addition the expansion mandrel 20 travels downwards, thus driving the inner jaws 22 radially outwards. Thus the inner jaws 22 and the outer jaws 21 form the shoulder-shaped stacking stopper 5. In order that the shoulder-shaped stacking stopper is formed in the way it is shown in FIG. 3, the cup is supported by the inner cup support 26, which supports the cup cone below the stacking stopper 5. The direction of motion of the outer jaws 21, the inner jaws 22, the expander mandrel 20 and the outer slider 23 are denoted during the closing of the pressing arrangement 19 by arrows.

The next procedural step is shown in FIG. 11. The pressing arrangement 19 is again completely open. To better illustrate the opening process of the pressing arrangement 19, the direction of motion during opening of the the pressing arrangement 19 of the expansion mandrel 20, the outer jaws 21, the inner jaws 22 and the outer slider 23 are denoted by arrows. In addition, the movement of the lower cup support 17, which sets in directly after the pressing arrangement 19 is opened, is denoted by an arrow.

After the forming station 16 is opened, the cup take-up 18 can be carried to the next position (FIG. 12), where the outer sleeve 2 is equipped with the inner cup 1. The further stages for finishing the paperboard cup are not described here.

The invention claimed is:

1. A double-walled stackable and de-stackable paperboard cup comprising an inner cup and an outer sleeve, with a gap between the inner cup and the outer sleeve, said outer sleeve being attached below a drinking lip of the inner cup and comprising a rolled lip applied to the lower end of the outer sleeve and disposed on an outer surface of the inner cup, wherein a continuous shoulder-shaped stacking stopper is provided on the outer sleeve and is configured to engage the complete circumference of the drinking lip of an adjacent stacked cup and wherein between an upper edge of the outer sleeve and the shoulder-shaped stacking stopper a first cylindrical or conical area in which the outer sleeve at least partly abuts the inner sleeve and a second conical area of the outer sleeve are arranged, said second conical area having an opposite conicity relative to a conicity of the outer sleeve between the shoulder-shaped stacking stopper and the rolled lip applied to the lower end of the outer sleeve.

2. A double-walled paperboard cup according to claim 1, wherein the shoulder-shaped stacking stopper is stabilized by means of an inner shoulder.

3. A double-walled stackable paperboard cup having a longitudinal axis and comprising:

an inner cup having a drinking lip; and an outer sleeve comprising a shoulder-shaped stacking stopper positioned at an upper end and a rolled lip positioned at a lower end, wherein the outer sleeve is attached to the inner sleeve below the drinking lip and the rolled lip of the outer sleeve is disposed on an outer surface of the inner cup, and wherein the stacking stopper is configured to engage the drinking lip of an adjacent stacked cup such that the total force between the stacking stopper and the drinking lip is directed normally and substantially parallel to the longitudinal axis and wherein between an upper edge of the outer sleeve and the shoulder-shaped stacking stopper a first cylindrical or conical area in which the outer sleeve at least partly abuts on the inner sleeve and a second conical area of the outer sleeve are arranged, said second conical area having an opposite conicity relative to a conicity of the outer sleeve between the shoulder-shaped stacking stopper and the rolled lip positioned at the lower end of the outer sleeve.

* * * * *